US006836207B2

(12) United States Patent
Nothhelfer et al.

(10) Patent No.: US 6,836,207 B2
(45) Date of Patent: Dec. 28, 2004

(54) STRIP CONDUCTOR HAVING AN ADDITIONAL LAYER IN A CURVED SECTION

(75) Inventors: Rainer Nothhelfer, Munich (DE); Thorsten Lange, Mindelheim (DE)

(73) Assignee: Tyco Electronics Amp GmbH (DE)

( * ) Notice: Subject to any disclaimer, the term of this patent is extended or adjusted under 35 U.S.C. 154(b) by 0 days.

(21) Appl. No.: 10/433,770

(22) PCT Filed: Nov. 21, 2001

(86) PCT No.: PCT/EP01/13518

§ 371 (c)(1),
(2), (4) Date: Nov. 28, 2003

(87) PCT Pub. No.: WO02/49045

PCT Pub. Date: Jun. 20, 2002

(65) Prior Publication Data

US 2004/0075520 A1 Apr. 22, 2004

(30) Foreign Application Priority Data

Dec. 14, 2000 (DE) ..... 100 62 403

(51) Int. Cl.[7] ..... H01C 10/22

(52) U.S. Cl. ..... 338/138; 338/217; 338/139; 338/142; 338/195; 338/307; 338/292; 338/293

(58) Field of Search ..... 338/195, 138, 338/139, 140, 142, 217, 292, 293, 307

(56) References Cited

U.S. PATENT DOCUMENTS

| | | | | | |
|---|---|---|---|---|---|
| 2,134,870 | A | * | 11/1938 | Fruth | 338/142 |
| 2,338,458 | A | * | 1/1944 | Schade | 338/142 |
| 3,324,440 | A | * | 6/1967 | Strief et al. | 338/162 |
| 4,146,853 | A | * | 3/1979 | Kiyono et al. | 333/81 R |
| 4,253,082 | A | * | 2/1981 | Davis, Jr. | 338/150 |
| 4,283,704 | A | * | 8/1981 | Ohtani et al. | 338/138 |
| 4,588,976 | A | * | 5/1986 | Jaselli | 338/284 |
| 5,184,108 | A | * | 2/1993 | Bloom et al. | 338/195 |
| 5,631,623 | A | * | 5/1997 | Yoshimura | 338/142 |
| 6,342,829 | B1 | * | 1/2002 | Takagi et al. | 338/153 |
| 6,529,116 | B2 | * | 3/2003 | Van Den Broek et al. | 338/309 |

FOREIGN PATENT DOCUMENTS

JP 11045802 2/1999 ..... H01C/7/02

OTHER PUBLICATIONS

Holmes et al. Handbook of THick Fllm Tech., Chp. 7 (by Crossland et al. pp. 137–143)(1976).*

PCT International Search Report, PCT/EP 01/13518, dated Sep. 12, 2002.

* cited by examiner

*Primary Examiner*—Karl D. Easthom

(57) ABSTRACT

A strip conductor comprises a first layer with at least one curved section. At least one region of the curved section provided with an additional layer having a smaller resistivity than the first layer. The at least one region is constructed such that resistance on tracks of different radii of curvature is approximately equalized.

18 Claims, 2 Drawing Sheets

STRIP CONDUCTOR HAVING AN ADDITIONAL LAYER IN A CURVED SECTION

BACKGROUND OF THE INVENTION

1. Field of the Invention

The invention relates to a strip conductor, which has at least one curved section comprising a strip conductor layer.

2. Summary of the Prior Art

Strip conductors are used in electronic circuits to connect electrical components with one another. Furthermore, it is known to arrange strip conductors in the form of a meandering resistance strip to fix a defined resistance on an electronic circuit. In the case of a meandering strip conductor, current density is distributed unevenly in the region of the curves, which may cause voltage peaks that lead to damage of the strip conductor.

To avoid disproportionately high voltages, which occur, for example, when lightning strikes, it is already known from the prior art to construct the strip conductor curves in the form of a low-resistance section of the strip conductor. The construction of the low-resistance section of the strip conductor offers the advantage that a raised voltage does not damage the low-resistance section of the strip conductor. The construction of the strip conductor curves in the form of low-resistance strip conductor sections has the disadvantage, however, that for a given resistance value the overall strip conductor length is extended, because the low-resistance strip conductor sections in the region of the strip conductor curves do not contribute to the effective resistance length.

SUMMARY OF THE INVENTION

The invention is based on the problem of producing a strip conductor with a strip conductor curve, which is of simple construction and at large voltages is protected against damage in a region of the curve. This problem is solved by a strip conductor as defined above, which in accordance with the invention, is characterised in that at least one region of the curved section is provided with an additional layer, having a smaller resistivity than the strip conductor, and the at least one region is constructed such that the resistance on tracks of different radii of curvature is approximately equalized. An important advantage of the invention is that an additional or second layer, which has a smaller resistivity than the material of the strip conductor, is applied to a curved section of the strip conductor in at least one region. The region is constructed so that resistance strips having different radii of curvature have an approximately equal resistance. This provides a strip conductor that is protected against voltage peaks in the region of the curve.

Further advantageous embodiments are described herein. Preferably, one region has a form that extends from a curve inside to a curve outside, the width of the form increasing from the curve inside to the curve outside.

In a preferred embodiment of the invention, only one region of the curved section has the second layer. In this way, the curved section to which no second layer has been applied also contributes to the effective resistance length, so that the strip conductor as a whole can be made shorter to present a fixed resistance, thereby saving area.

A preferred embodiment of the region in which the second layer is formed comprises the form of a segment of a circle, the midpoint of the circle being arranged on the curve inside of the curved section.

Preferably, the second layers are formed in several regions of the section, in order to achieve a current distribution that is as uniform as possible over the width of the strip conductor and at the same a time to obtain a maximum contribution of the curved section to the effective resistance length.

DETAILED DESCRIPTION OF THE PREFERRED EMBODIMENT

Figure 1:
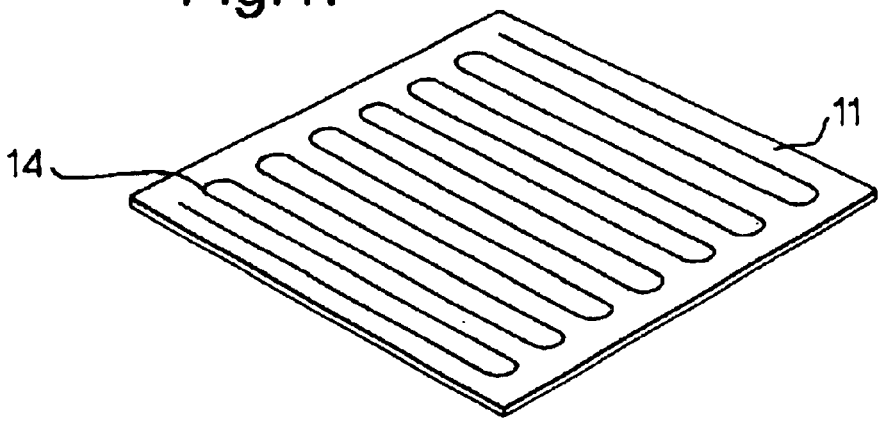
FIG. 1 schematically shows a meandering resistance strip on an electronic circuit, FIG. 2 schematically shows a section of the meandering resistance strip in the region of a curve, FIG. 3 schematically shows a ceramics plate, to which the second layer and the strip conductor are applied, and FIG. 4 schematically shows a strip conductor having a second layer beneath it for the entire curve region.

FIG. 1 shows a strip conductor having a meandering resistance strip 14. The resistance strip 14 consists of straight sections and curved sections. The resistance of the resistance strip 14 is proportional to a length of the resistance strip 14. The straight sections are arranged close together and the curved sections have a predetermined radius of curvature. The construction of the resistance strip 14 as a meandering strip conductor enables a relatively long strip conductor to be formed on a given area, so that little area is needed for a given resistance. Two ends of the resistance strip 14 are connected, for example, to electrical components.

The invention is described hereafter with reference to a resistance strip, but it is possible to use the invention for any strip conductor.

Figure 2:
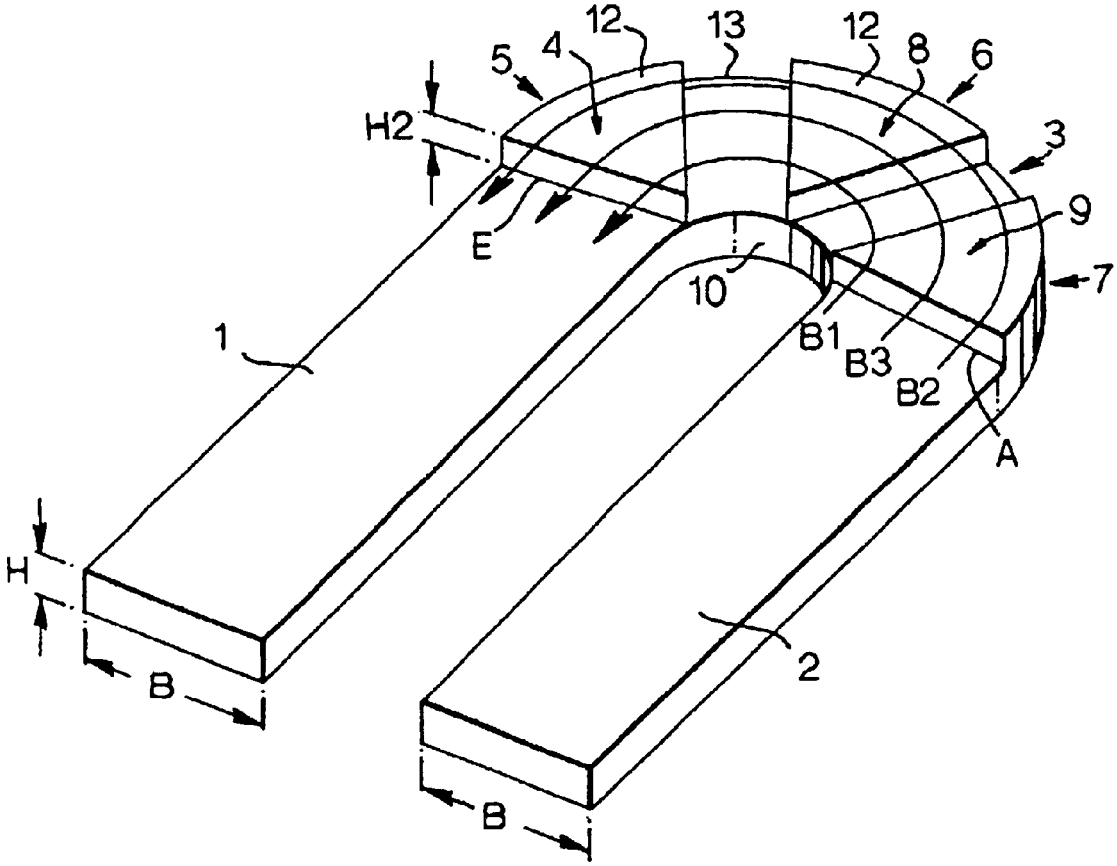

FIG. 2 shows by way of non-limiting example a view in partial section of the resistance strip 14 of FIG. 1. The resistance strip 14 comprises a first straight section 1, a second straight section 2 and a curved third section 3, which joins the first and the second sections 1, 2 together. The first, second and third sections 1, 2, 3 preferably have the same width B of about 0.6-1.2 mm. The height H of the first, second and third sections 1, 2, 3 is likewise the same, and lies, for example, within the range from 10-15 $\mu$m. The first, second and third sections 1, 2, 3 are approximately rectangular in cross-section and are in the form of a one-piece strip conductor, representing a first layer of the structure.

First, second and third strip conductor portions 4, 8, 9 are applied to the third section 3 in respective first, second and third regions 5, 6, 7. The width of the first, second and third strip conductor portions 4, 8, 9 corresponds to the width of the third section 3. The height of the first, second and third strip conductor portion 4, 8, 9 corresponds to a given second height H2, which lies, for example, in the range from 10 to 15 $\mu$m. The first, second and third strip conductor portions 4, 8, 9 represent a second or additional layer 12.

The shape of the first, second and third regions 5, 6, 7 preferably corresponds to a segment of a circle, the segment of the circle having its circle midpoint in a region of a curve inside 10 of the first strip conductor portion 4.

The first, second and third strip conductor portions 4, 8, 9 are preferably manufactured from a second material and the first, second and third sections 1, 2, 3 from a first material, the second material having a lower resistivity than the first material. The layer thickness of the first, second and third strip conductor portions 4, 8, 9, the shape of the first, second and third regions 5, 6, 7 and the resistivity of the second material are matched to a radius of curvature of the first strip conductor portion 4, so that for as far as possible a uniform current distribution over the width of the third section 3 is achieved.

For uniform distribution of the current, it is an advantage if the electrical resistance along tracks of constant but different size radii for the entire curve is the same. An outer second track B2 has a larger radius of curvature than an inner first track B1. A middle third track B3 has a smaller radius of curvature than the outer second track B2 and a larger radius of curvature than the inner first track B1. The task of the second layer 12 is to adjust the resistance for the different tracks B1, B2, B3 so that the track resistance for the tracks B1, B2, B3 from a start line A to a finish line B is approximately the same. The start line A represents the start and the end line E represents the end of the curved third section 3. With track resistances of equal magnitude, a uniform distribution of the current over the width of the third section 3 and a uniform distribution of the power loss is achieved, so that the third section 3 is uniformly loaded.

Instead of the circle segment form of the first, second or third regions 5, 6, 7, in which a second layer 12 is applied to the third section 3, any other geometry with which the resistance in the curved third section 3 is equalized across the width of the third section 3 can be chosen. Without the second layer 12, the resistance on the outer second track B2 is greater than on the inner first track B1. Shapes of the first, second, and third regions 5, 6, 7 that have a width, viewed in the curve direction, that increases from the curve inside 10 towards a curve outside 13 are suitable for equalization. The first, second, and third regions 5, 6, 7 extend preferably from the curve inside 10 to the curve outside 13.

The first material for the first, second and third sections 1, 2, 3 is preferably a resistance paste containing metal and glass particles, which is fired to produce the resistance strip 14. The second material for the first, second and third strip conductor portions 4, 8, 9 is, for example, a silver-containing paste, which is likewise fired to produce the first, second and third strip conductor portions 4, 8, 9. The resistivity of the second material can be selected to be as small as desired. Preferably, the second material has a sheet resistance of less than 50 mΩ/square. The resistance strip 14 having the first, second and third sections 1, 2, 3 is preferably made from a material that has a sheet resistance of more than 100 mΩ/square.

Figure 3:
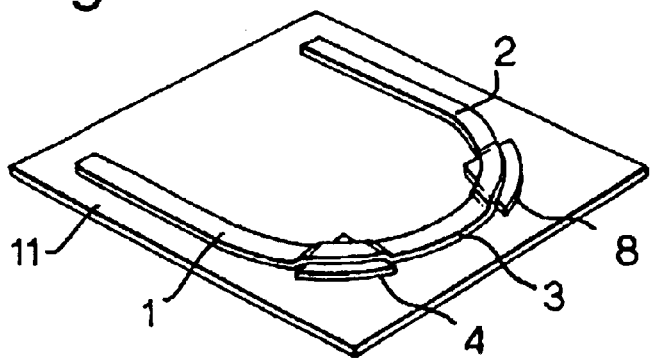

FIG. 3 shows a strip conductor having first, second, and third sections 1, 2, 3 applied to a ceramics plate 11. The third section 3 is taken over the first and second strip conductor portions 4, 8. The first and second strip conductor portions 4, 8 are manufactured from a material that has a lower resistivity than the material of the third section 3. In a simple manufacturing process the first and second strip conductor portions 4, 8 are applied to the ceramics plate 11 by screen-printing. The strip conductor with the first and second strip conductor portions 4, 8 is subsequently applied by screen-printing. The ceramics plate 11 is then introduced into a drying kiln and the printed-on paste are dried at 800° C.

Figure 4:
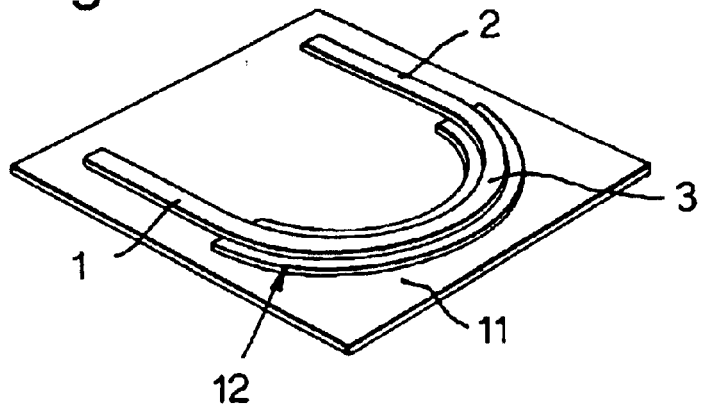

FIG. 4 shows a simple embodiment of the invention, in which the entire curved third section 3 has a second layer 12 of lower resistivity beneath it. In this embodiment, the third section 3 is protected from high current densities, but the third section 3 makes no contribution to the effective resistance length and hence no contribution to the given resistance.

A preferred application of the invention is in electronic circuits for telephone apparatus or telephone systems that are protected by the inventive construction of the curves of strip conductors, for example, resistance strips, against current peaks, which occur, for example, when lightning strikes.

It will be understood by those skilled in the art that the present invention is not limited to the embodiments shown and that many additions and modifications are possible without departing from the scope of the present invention as defined in the appending claims.

What is claimed is:

1. A strip conductor, comprising:

a first layer with at least one curved section, at least one of the curved sections having a plurality of regions each provided with a separate additional layer having a smaller resistivity than the first layer, the separate additional layer being constructed such that resistance on tracks of different radii of curvature in each of the curved sections is approximately equalized; and the strip conductor being in the form of a resistance strip that represents a given resistance value, the resistance strip being constructed in the form of the meandering track.

2. The strip conductor according to claim 1, wherein the shape of the plurality of regions corresponds to a segment of a circle.

3. The strip conductor according to claim 1, wherein the separate additional layers are applied to a ceramics plate by a screen-printing process and the strip conductor is applied to the separate additional layers and the ceramics plate by a screen-printing process.

4. The strip conductor according to claim 1, wherein the separate additional layers have a width that increases from an inner first track with a first radius of curvature to an outer second track with a second radius of curvature larger than the first radius of curvature.

5. The strip conductor according to claim 4, wherein the plurality of regions provided with the separate additional layers are arranged spaced from one another.

6. The strip conductor according to claim 1, wherein the at least one curved section is made from a first material and the separate additional layers are made from a second material, the first material having a higher resistivity than the second material.

7. The strip conductor according to claim 6, wherein the first material has a sheet resistance of more than 100 mΩ/square.

8. The strip conductor according to claim 6, wherein the second material has a sheet resistance of less than 50 mΩ/square.

9. The strip conductor according to claim 6, wherein the first material is a resistance paste containing metal and glass particles.

10. The strip conductor according to claim 6, wherein the second material is a silver-containing paste.

11. A strip conductor arrangement, comprising:

a first layer with at least one curved section, at least one of the curved sections having a plurality of regions each provided with a separate additional layer having a smaller resistivity than the first layer, the separate additional layer being constructed such that resistance on tracks of different radii of curvature in each of the curved sections is approximately equalized, and the separate additional layers being arranged between the first layer and a non-conductive plate.

12. The strip conductor arrangement according to claim 11, wherein the separate additional layers have a width that increases from an inner first track with a first radius of curvature to an outer second track with a second radius of curvature larger than the first radius of curvature.

13. The strip conductor arrangement according to claim 12, wherein the separate additional layers are wedge shaped.

14. The strip conductor arrangement according to claim 11, wherein the at least one curved section is made from a first material and the separate additional layers are made from a second material, the first material having a higher resistivity than the second material.

15. The strip conductor arrangement according to claim 14, wherein the first material has a sheet resistance of more than 100 mΩ/square.

16. The strip conductor arrangement according to claim 15, wherein the first material is a resistance paste containing metal and glass particles.

17. The strip conductor arrangement according to claim 15, wherein the second material has a sheet resistance of less than 50 mΩ/square.

18. The strip conductor arrangement according to claim 17, wherein the second material is a silver-containing paste.

* * * * *

UNITED STATES PATENT AND TRADEMARK OFFICE

CERTIFICATE OF CORRECTION

PATENT NO. : 6,836,207 B2
DATED : December 28, 2004
INVENTOR(S) : Nothhelfer et al.

It is certified that error appears in the above-identified patent and that said Letters Patent is hereby corrected as shown below:

Title page,
Item [56], References Cited, OTHER PUBLICATIONS, "Holmes et al. Handbook of THick Film Tech.," should read -- Holmes et al. Handbook of Thick Film Tech., --.

Column 4,
Line 35, "the meandering" should read -- a meandering --.

Signed and Sealed this

Nineteenth Day of April, 2005

JON W. DUDAS
*Director of the United States Patent and Trademark Office*